US008221292B2

(12) United States Patent
Barker et al.

(10) Patent No.: US 8,221,292 B2
(45) Date of Patent: Jul. 17, 2012

(54) USER STATUS NOTIFICATION SYSTEM

(75) Inventors: Robert J. Barker, UP Nately (GB); James S. Birrell, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 0 days.

(21) Appl. No.: 12/693,151

(22) Filed: Jan. 25, 2010

(65) Prior Publication Data

US 2011/0183813 A1 Jul. 28, 2011

(51) Int. Cl.
*A63B 71/00* (2006.01)

(52) U.S. Cl. ..... 482/8

(58) Field of Classification Search ..... 482/1, 8
See application file for complete search history.

(56) References Cited

U.S. PATENT DOCUMENTS

| | | | | |
|---|---|---|---|---|
| 4,720,789 | A | 1/1988 | Hector et al. | 463/33 |
| 4,828,257 | A | 5/1989 | Dyer et al. | 482/5 |
| 4,831,242 | A * | 5/1989 | Englehardt et al. | 235/382 |
| 4,840,372 | A | 6/1989 | Oglesby et al. | 482/9 |
| 4,955,602 | A | 9/1990 | Rastelli | 482/84 |
| 4,998,725 | A | 3/1991 | Watterson et al. | 482/6 |
| 5,062,626 | A | 11/1991 | Dalebout et al. | 482/1 |
| 5,062,632 | A | 11/1991 | Dalebout et al. | 482/7 |
| 5,067,710 | A | 11/1991 | Watterson et al. | 482/3 |
| 5,104,120 | A | 4/1992 | Watterson et al. | 482/5 |
| 5,149,084 | A | 9/1992 | Dalebout et al. | 482/3 |
| 5,213,555 | A | 5/1993 | Hood et al. | 482/57 |
| 5,383,826 | A | 1/1995 | Michael | 482/3 |
| 5,466,200 | A | 11/1995 | Ulrich et al. | 482/4 |
| 5,484,355 | A | 1/1996 | King, II et al. | 482/4 |
| 5,489,249 | A | 2/1996 | Brewer et al. | 482/5 |
| 5,512,025 | A | 4/1996 | Dalebout et al. | 482/6 |
| 5,554,033 | A | 9/1996 | Bizzi et al. | 434/247 |
| 5,591,104 | A | 1/1997 | Andrus et al. | 482/7 |
| 5,645,509 | A | 7/1997 | Brewer et al. | 482/4 |
| 5,655,997 | A | 8/1997 | Greenberg et al. | 482/5 |
| 5,706,822 | A | 1/1998 | Khavari | 600/483 |
| 5,777,895 | A | 7/1998 | Kuroda et al. | 702/188 |
| 5,785,632 | A | 7/1998 | Greenberg et al. | 482/5 |
| 5,888,172 | A | 3/1999 | Andrus et al. | 482/7 |
| 5,890,995 | A | 4/1999 | Bobick et al. | 482/4 |
| 5,916,063 | A | 6/1999 | Alessandri | 482/4 |
| 5,931,763 | A | 8/1999 | Alessandri | 482/4 |
| 6,042,519 | A | 3/2000 | Shea | 482/57 |
| 6,053,844 | A | 4/2000 | Clem | 482/8 |
| 6,059,692 | A | 5/2000 | Hickman | 482/8 |
| 6,066,075 | A | 5/2000 | Poulton | 482/8 |
| 6,152,856 | A | 11/2000 | Studor et al. | 482/8 |
| 6,159,131 | A | 12/2000 | Pfeffer | 482/8 |
| 6,171,218 | B1 | 1/2001 | Shea | 482/57 |
| 6,193,631 | B1 | 2/2001 | Hickman | 482/8 |
| 6,227,968 | B1 | 5/2001 | Suzuki et al. | 463/7 |
| 6,244,988 | B1 | 6/2001 | Delman | 482/8 |
| 6,312,363 | B1 | 11/2001 | Watterson et al. | 482/54 |

(Continued)

FOREIGN PATENT DOCUMENTS

EP 1755098 2/2007

(Continued)

*Primary Examiner* — Loan Thanh
*Assistant Examiner* — Shila Jalalzadeh Abyane
(74) *Attorney, Agent, or Firm* — Terrence P. O'Brien; Todd A. Rathe

(57) ABSTRACT

A user status notification system and method indicate to non-users proximate the fitness equipment unit status information pertaining to the user while the user is using the fitness equipment unit.

22 Claims, 3 Drawing Sheets

U.S. PATENT DOCUMENTS 6,330,499 B1 12/2001 Chou et al. ..... 701/33
6,336,891 B1 1/2002 Fedrigon et al. ..... 482/8
6,421,571 B1 7/2002 Spriggs et al. ..... 700/17
6,447,424 B1 9/2002 Ashby et al. ..... 482/8
6,458,060 B1 10/2002 Watterson et al. ..... 482/54
6,464,618 B1 10/2002 Shea ..... 482/8
6,475,115 B1 11/2002 Candito et al. ..... 482/4
6,514,199 B1 2/2003 Alessandri ..... 600/300
6,554,706 B2 4/2003 Kim et al. ..... 463/36
6,572,512 B2 6/2003 Anderson et al. ..... 482/51
6,601,016 B1 7/2003 Brown et al. ..... 702/182
6,616,578 B2 9/2003 Alessandri ..... 482/8
6,626,799 B2 9/2003 Watterson et al. ..... 482/4
6,626,800 B1 9/2003 Casler ..... 482/8
6,634,992 B1 10/2003 Ogawa ..... 482/8
6,638,198 B1 10/2003 Shea ..... 482/8
6,659,916 B1 12/2003 Shea ..... 482/57
6,702,719 B1 3/2004 Brown et al. ..... 482/8
6,746,371 B1 6/2004 Brown et al. ..... 482/8
6,827,669 B2 12/2004 Cohen et al. ..... 482/8
6,863,641 B1 3/2005 Brown et al. ..... 482/8
6,866,613 B1 3/2005 Brown et al. ..... 482/8
6,902,513 B1 6/2005 McClure ..... 482/8
6,918,858 B2 7/2005 Watterson et al. ..... 482/54
6,921,351 B1 7/2005 Hickman et al. ..... 482/8
6,971,973 B2 12/2005 Cohen et al. ..... 482/8
6,991,586 B2 1/2006 Lapcevic ..... 482/8
6,997,852 B2 2/2006 Watterson et al. ..... 482/1
7,022,047 B2 4/2006 Cohen et al. ..... 482/8
7,056,265 B1 6/2006 Shea ..... 482/8
7,060,006 B1 6/2006 Watterson et al. ..... 482/54
7,060,008 B2 6/2006 Watterson et al. ..... 482/54
7,070,539 B2 7/2006 Brown et al. ..... 482/8
7,121,982 B2 10/2006 Feldman ..... 482/8
7,128,693 B2 10/2006 Brown et al. ..... 482/8
7,166,062 B1 1/2007 Watterson et al. ..... 482/8
7,166,064 B2 1/2007 Watterson et al. ..... 482/54
7,217,224 B2 5/2007 Thomas ..... 482/8
7,331,226 B2 2/2008 Feldman et al. ..... 73/379.01
7,402,125 B2 * 7/2008 Wang ..... 482/1
7,455,622 B2 11/2008 Watterson et al. ..... 482/8
7,491,153 B2 2/2009 Li et al. ..... 482/8
7,507,183 B2 3/2009 Anderson et al. ..... 482/1
7,521,623 B2 4/2009 Bowen ..... 84/612
7,537,546 B2 5/2009 Watterson et al. ..... 482/8
7,549,947 B2 6/2009 Hickman et al. ..... 482/8
7,556,590 B2 7/2009 Watterson et al. ..... 482/8
7,575,536 B1 8/2009 Hickman ..... 482/8
7,594,873 B2 9/2009 Terao et al. ..... 482/1
7,618,346 B2 11/2009 Crawford et al. ..... 482/8
7,621,846 B2 11/2009 Ainsworth et al. ..... 482/8
2001/0049320 A1 12/2001 Cohen et al. ..... 482/8
2002/0019258 A1 2/2002 Kim et al. ..... 463/36
2002/0022551 A1 2/2002 Watterson et al. ..... 482/8
2002/0055383 A1 5/2002 Onda et al. ..... 463/36
2002/0055419 A1 5/2002 Hinnebusch ..... 482/8
2002/0077219 A1 6/2002 Cohen et al. ..... 482/8
2002/0097150 A1 7/2002 Sandelman et al. ..... 340/506
2003/0009376 A1 1/2003 Ekstrom ..... 705/14.53
2005/0015281 A1 1/2005 Clark et al. ..... 705/2
2005/0283051 A1 * 12/2005 Chen ..... 600/300
2006/0172858 A1 * 8/2006 Chen ..... 482/8
2007/0033068 A1 * 2/2007 Rao et al. ..... 705/2
2007/0033069 A1 * 2/2007 Rao et al. ..... 705/2
2007/0219059 A1 9/2007 Schwartz ..... 482/8
2007/0225118 A1 9/2007 Giorno et al. ..... 482/1
2007/0232452 A1 10/2007 Hanoun ..... 482/6
2007/0260482 A1 11/2007 Nurmela et al. ..... 705/2
2007/0265138 A1 11/2007 Ashby ..... 482/8
2007/0265139 A1 11/2007 Glick ..... 482/8
2008/0015088 A1 * 1/2008 Del Monaco ..... 482/4
2008/0051256 A1 2/2008 Ashby et al. ..... 482/5
2008/0153670 A1 6/2008 McKirdy et al. ..... 482/1
2008/0161654 A1 7/2008 Teller et al. ..... 600/300
2008/0182723 A1 7/2008 Aaron et al. ..... 482/8
2008/0200312 A1 8/2008 Tagliabue ..... 482/9
2008/0207401 A1 8/2008 Harding et al. ..... 482/4
2008/0220941 A1 9/2008 Shaw et al. ..... 482/9
2009/0023553 A1 1/2009 Shim ..... 482/4
2009/0075781 A1 3/2009 Schwarzberg et al. ..... 482/8
2009/0098980 A1 4/2009 Waters ..... 482/8
2009/0098981 A1 4/2009 Del Giorno ..... 482/9
2009/0111656 A1 4/2009 Sullivan et al. ..... 482/4
2009/0118100 A1 5/2009 Oliver et al. ..... 482/8
2009/0139389 A1 6/2009 Bowen ..... 84/636
2009/0144080 A1 6/2009 Gray et al. ..... 705/2
2009/0156364 A1 6/2009 Simeoni ..... 482/9
2009/0163321 A1 6/2009 Watterson et al. ..... 482/4
2009/0219159 A1 9/2009 Morgenstern ..... 340/573.1
2009/0221404 A1 9/2009 Dorogusker et al. ..... 482/8
2009/0233770 A1 9/2009 Vincent et al. ..... 482/8
2009/0233771 A1 9/2009 Quatrochi et al. ..... 482/9
2009/0239709 A1 9/2009 Wu ..... 482/8
2009/0240113 A1 9/2009 Heckerman ..... 600/300
2009/0253554 A1 10/2009 McIntosh ..... 482/4
2009/0258758 A1 10/2009 Hickman et al. ..... 482/8
2009/0262088 A1 10/2009 Moll-Carrillo et al. ..... 345/173
2009/0269728 A1 10/2009 Verstegen ..... 434/247
2009/0270227 A1 10/2009 Ashby et al. ..... 482/8

FOREIGN PATENT DOCUMENTS

EP 1878473 1/2008
WO WO2008/069966 6/2008

* cited by examiner

USER STATUS NOTIFICATION SYSTEM

BACKGROUND

It is often difficult for fitness club or gym counselors, trainers, managers or other personnel to identify exercising individuals who may need encouragement, advice or other assistance. As a result, many individuals may not receive the needed encouragement, advice or other assistance. This may lead to the individual improperly using fitness equipment or may lead to the individual becoming discouraged and reducing attendance or discontinuing membership.

DETAILED DESCRIPTION OF THE EXAMPLE EMBODIMENTS

Figure 1:
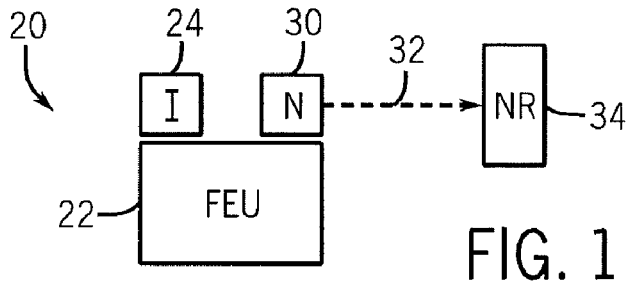
FIG. 1 is a schematic illustration of a user status notification system according to an example embodiment.

FIG. 1 schematically illustrates user status notification system 20 according to an example embodiment. User status notification system 20 notifies persons proximate to or about an exercise machine or device (referred to hereafter as a fitness equipment unit) of a status of a person who is presently using the fitness equipment unit. User status notification system 20 indicates or provides such status information to non-users of the particular fitness equipment unit, such as fitness club managers, coaches, trainers, membership representatives or other personnel who may be walking nearby in a fitness facility, such that appropriate encouragement, advice or other assistance may be offered to the person using the fitness equipment unit.

User status notification system 20 may be utilized in locations or environments where trainers, counselors, managers, representatives, coaches or other individuals are available to provide assistance or encouragement. Examples of such environments include, but are not limited to, fitness clubs, gyms, workout facilities and the like. User status notification system 20 comprises fitness equipment unit 22, input 24 and notifier 30.

Fitness equipment unit 22 comprises an individual unit or machine configured to facilitate or assist a person in exercising. Fitness equipment unit 22 may assist in either cardiovascular or strength conditioning exercise. Examples of fitness equipment unit 22 include, but are not limited to, elliptical machines, stair steppers or climbers, treadmills, adaptive motion machines, rowing machines, bench press machines, upright and recumbent cycles, cross trainers, strength training equipment and the like.

Input 24 comprises a device associated with fitness equipment unit 22 that is configured to receive input identifying a particular human user using fitness equipment unit 22. In one embodiment, input 24 may be associated with fitness equipment unit 22 by being directly connected to, mounted upon or provided as part of fitness equipment unit 22. In another embodiment, input 24 may be associated with fitness equipment unit 22 by being located within a particular area or region of a facility containing fitness equipment unit 22. For example, input 24 may be provided adjacent a door to a room containing fitness equipment unit 22 or on a wall proximate to fitness equipment unit 22.

According to one embodiment, input 24 comprises a user interaction device that actively requests, prompts or receives input directly from the person using the fitness of unit 22 (or entering the region containing fitness equipment unit 22). In such embodiments, input 24 may comprise a keyboard or keypad, a touch screen, a microphone with a computing device having associated voice or speech recognition software, a card reader or a biometric sensing device, wherein the person using fitness equipment unit 22 enters his or her identification information either manually, audibly or by positioning a card (magnetic or electronic) in a card reader or by positioning his or her anatomy with respect to the biometric sensing device.

In yet other embodiments, input 24 may comprise a passive person identification device which identifies a person using fitness equipment unit 22 without any active participation or specific actions on part of the person using fitness equipment unit 22. For example, input 24 may comprise a camera or other image capturing device and a computing device having associated face recognition software. Input 24 may comprise a sensing device that senses a security or identification token, sometimes referred to as a key fob, assigned or designated to the particular user or person and located within a predetermined proximity to the sensing device, such as when the person is seated upon a portion of the fitness equipment unit or is using the fitness equipment unit. In some embodiments, such identification tokens may rely on radio frequency identification tags and transponders. Overall, input device 24 provides notifier 30 (and its electronic or computerized controller) with the identity of the particular person using or about to use fitness equipment unit 22.

Notifier 30 comprises a device having one or more emitters configured to give off or emit electromagnetic radiation (light, sound, infrared, ultraviolet, ultrasound, etc) and one or more controllers (processing units, control circuits etc) that selectively or controllably actuate the emitters to notify or indicate to those persons or individuals around or proximate to fitness equipment unit 22, who are not using fitness equipment unit 22, information or data regarding or pertaining to the person using fitness equipment unit 22 while the person is using fitness equipment unit 22. For purposes of this disclosure, using fitness equipment unit 22 includes the time from when a person is identified by input 24, while the person is exercising and after the person has completed exercising but is still in close proximity to the fitness equipment unit 22. Examples of individuals who may be proximate to fitness equipment unit 22 but not using fitness equipment unit 22 include persons who may be walking around or about fitness equipment unit 22 while the person is using fitness equipment unit 22. Such persons may include coaches, trainers, fitness facility representatives or managers and the like who may be able to offer assistance or encouragement. According to one example embodiment, notifier 30 visibly communicates such information to those individuals which are within 10 feet of notifier 30. In other embodiments, this range may be varied In one embodiment, notifier 30 may be provided as part of a display screen, control panel or monitor associated with fitness equipment unit 22. In yet another embodiment, notifier 30 may comprise one or more lights or illumination devices or one or more sound emitting devices mounted to a fitness equipment unit 22 or supported at a location proximate to fitness equipment unit 22, such as a wall, floor or other structure in close proximity to fitness equipment unit 22.

Notifier 30 provides or indicates status information pertaining to a person using fitness equipment unit 22 to those individuals not using fitness equipment unit 22 but in proximity to fitness equipment unit 22. The status information provided by notifier 30 is based upon (1) the identity of the person using fitness equipment unit 22 as provided or determined by input 24 and (2) stored information related to the person using fitness equipment unit 22. In the embodiment illustrated, the information relating to the person using fitness equipment unit 22 is stored in a memory or database supported by fitness equipment unit 22 or provided as part of input 24 or notifier 30. In other embodiments, the information relating to the person using fitness equipment unit 22 may be stored remote from fitness equipment unit 22 such as in a remote computer, virtual network, or a remote server. In one embodiment, the status information communicated by notifier 30 is unrelated to the particular characteristics of fitness equipment unit 22 presently being used by the person, the exertion level or physical parameters or physical characteristics of the user, or any exercise routine or program being performed or run on the fitness equipment unit 22 by the person using fitness equipment unit 22 (the user).

For example, in one embodiment, status information communicated by notifier 30 may indicate an age or duration of the user's membership or attendance at the particular fitness club or fitness facility. With such information, those individuals around the user during his or her use of fitness equipment unit 22 may determine if the user is new to the fitness facility and may need or find helpful additional assistance or device regarding use of the particular fitness equipment unit 22 or regarding other fitness equipment unit 22 which may serve the user's fitness objectives.

In another embodiment, status information communicated by notifier 30 may indicate the user's frequency of attendance at the fitness facility. With such information, those individuals around the user during his or her use of fitness equipment unit 22 may determine if the user has infrequently attended the fitness facility. Based on this determination, those individuals may offer encouragement, incentives, or offer suggestions for reducing the boredom or tediousness of workouts. Those individuals may also offer care and concern by inquiring as to dissatisfaction user may be experiencing or any reason for the low attendance. In yet other circumstances, those individuals nearby the user while the user is using fitness equipping unit 22 may offer rewards or incentives to those persons who have very strong, frequent or consistent workout attendance records as indicated by the status information. For example, those users having high attendance may be rewarded on the spot with discounts, coupons, gift certificates, awards or other rewards.

In yet another embodiment, the status information communicated by notifier 30 may indicate the user's familiarity or experience with respect to the particular fitness equipment unit 22 being presently used. Such status information may be based upon the number of times or number of days at the user as used the particular fitness equipment unit 22 or the number of hours her time spent on the particular fitness equipment unit 22. With such information, those individuals around the user (within 5 feet of the fitness equipment unit 22 being used) during his or her use of fitness equipment unit 22 may offer advice or assistance with respect to the use of the particular fitness equipment unit 22.

In other embodiments, the status information communicated by notifier 30 may indicate a level of exertion being exerted by the user at any particular moment in time. Such status information will be based in part upon the users fitness level stored in a database associated with notifier 30 or fitness equipment unit 22 and the sense or otherwise determined current level of activity on the fitness equipment unit 22. With such information, those individuals around the user during his or her use of fitness equipment unit 22 may determine whether the user is pushing himself or herself during a particular exercise or is exerting relatively little effort. Based on this determination, those individuals around the user may offer encouragement to the user to either to keep going at the current high exertion level or to increase the exertion level if the user is not pushing himself or herself. In certain circumstances, those individuals around the user may determine whether closer attention should be given to the particular user where high exertion levels may present a health concern or where the system recognizes that the user could benefit from using a different type of program and suggest options based on the individual's fitness goals.

The above noted types of status information are but a few examples of status information that may be indicated by notifier 30. Such status information may serve as warning notices to those around a person exercising that assistance or encouragement may be beneficial. In particular embodiments, more than one piece of status information many can indicated or indicated at one time.

In one embodiment, notifier 30 communicates or indicates such status information in a relatively discreet manner so as to not interrupt or interfere with the user's exercise routine and so as to not draw inordinate concern or attention to the user by those around the user who are not familiar with the one of more meanings associated with the notification method or medium. In this manner, the user will not be distracted, confused, or embarrassed by notifier 30.

In one embodiment, notifier 30 communicates such status information through notification methods or mediums which do not directly state the status information, but which correspond to the status information. For example, in one embodiment, notifier 30 may communicate such status information using one or more colors being displayed or emitted. In one embodiment, notifier 30 may be part of a display screen associated with fitness equipment unit 22, wherein one or more particular colors are displayed or presented by notifier 30 which correspond to particular status information for the current user of fitness equipment unit 22. Such one or more colors may be presented by providing background colors to a display screen associated with the fitness equipment unit while the user is using fitness equipment unit 22, by illuminating one or more light emitting diodes associated with fitness equipment unit 22, by illuminating one or more selected portions of a display or control panel associated with fitness equipment unit 22 or by illuminating one of more color emitting devices, such as lights, provided as part of or proximate to fitness equipment unit 22. For example, different colors may correspond to different designated membership ages, attendance frequencies or levels, familiarity levels or exertion levels.

In another embodiment, such status information may be discreetly communicated by notifier 30 selectively illuminating portions of a display screen, light emitting diodes or other lights at particular locations, at particular frequencies or in particular patterns. For example, different patterns or frequencies of light or the elimination of different regions such as different areas of a screen or control panel may correspond to different designated membership ages, attendance frequencies or levels, familiarity levels or exertion levels. The regions of the display may also include iconographic symbols and images that translate more information than a simple light. For instance the icon could be a horizontal or vertical bar. The amount of the bar that is filled in could indicate the severity of the situation.

In another embodiment, such status information may be discreetly communicated or indicated by notifier 30 providing auditory sounds, patterns or signals, wherein different auditory sounds, different patterns or different frequencies may correspond to different designated membership ages, attendance frequencies or levels, familiarity levels or exertion levels. In each instance, the status information is discreet in that the user exercising is less likely to directly associate a particular color, particular sound, light frequency or pattern or sound frequency or pattern with any particular characteristic of the user. Likewise, other patrons of the fitness facility who are not authorized and who are not taught the meanings of such notification methods or mediums are less likely to understand what is being communicated. As a result, a certain level of privacy is maintained while at the same time providing real-time instantaneous user status information to those around the user who may offer needed encouragement or assistance.

As shown by FIG. 1, in some embodiments, notifier 30 may be configured to emit wireless signals or electromagnetic radiation 32 which are not perceptible to humans without additional electronic sensing or amplification devices. Such non-human perceptible signals include the above status information pertaining to the user of fitness equipment unit 22. In such an embodiment, user status notification system 20 additionally includes notification receiver 34. Notification receiver 34 comprises a device configured to provide human perceptible signals based upon being non-human perceptible signals. In the embodiment schematically illustrated, notification receiver 34 comprises a portable unit size and configured to be manually carried by a single person (handheld). In one embodiment, notification receiver 34 is less than 5 pounds and nominally less than 2 pounds. Notification receiver 34 is sized so as to fit within a standard shirt or pants pocket. For example, notification receiver 34 may have dimensions similar to or less than dimensions of present day cell phones or personal data assistants. In some embodiments, notification receiver 34 may include clips or other attachment structures for being secured to a person's belt. As a result, notification receiver 34 may be easily carried around a fitness facility by those individuals who may be authorized and capable of offering encouragement and/or device in response to status information provided by notification receiver 34. In some embodiments, receiver 34 may be a single or series of mobile phones, personal data assistants (PDAs) or other existing portable electronic devices, greatly enhancing the efficiency of transferring the information.

In one embodiment, notification receiver 34 receives signals 32 when notification receiver 34 is within a predetermined threshold distance of notifier 30. For example, one about, notification receiver 34 receives signals 32 when notification receiver 34 is within 10 feet and nominally within 5 feet of notifier 30. In response to receiving signals 32, notification receiver 34 converts such non-human perceptible signals to human perceptible signals, alerting and providing the person carrying notification receiver 34 with the status information for the particular user on the particular fitness equipment unit 22 closest to notification receiver 34. In one embodiment, the human perceptible signals provided by notification receiver 34 are similar to those signals described above. In particular, notification receiver 34 may provide such status information using different colors of light, different sounds or different patterns, frequencies or origin locations of light, color or sound.

For example, in one embodiment, notification receiver 34 may change illumination levels or colors or actuate from an off state to an illuminated state upon being located within a certain proximity of a notifier 30 when the user of the fitness equipment unit 22 associated with notifier 30 meets certain predetermined criteria threshold such as certain membership age thresholds, attendance thresholds, familiarity thresholds or exertion thresholds. In some embodiments, notifier 30 may provide both human perceptible signals discernible by those proximate to the user exercising without notification receiver 34 and non-human perceptible signals which are only perceptible to those individuals having notification receiver 34. In some embodiments, the non-human perceptible signal 32 may be received by an external device or intermediate device that forwards the same non-human perceptible signals onward to notification receiver 34 or that generates new signals based upon the signals from notifier 34, wherein the new signals direct or instruct notification receiver 34 to present particular status information to the person carrying notification receiver 34.

Figure 2:
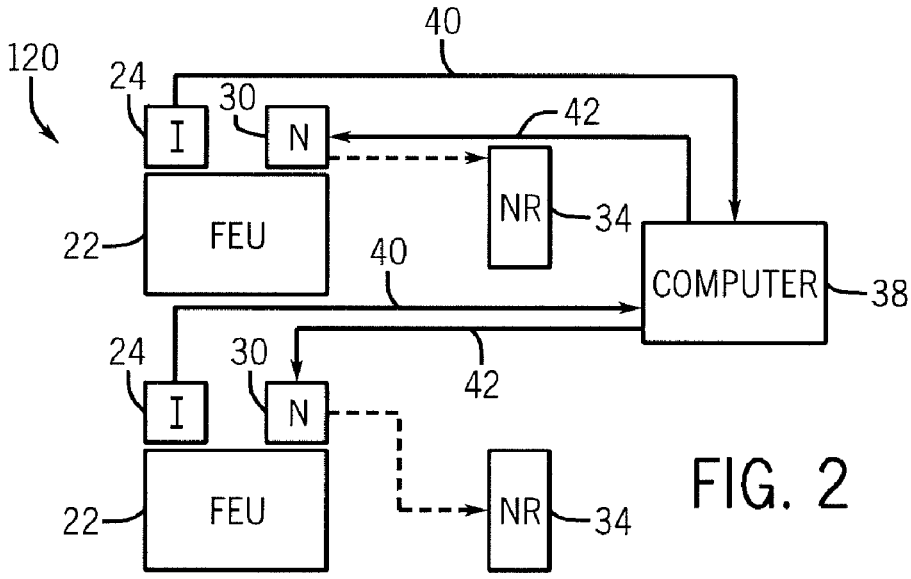
FIG. 2 is a schematic illustration of another embodiment of the user status notification system of FIG. 1.

FIG. 2 schematically illustrates user status notification system 120, another embodiment of notification system 20. As shown by FIG. 2, user status notification system 120 includes a plurality of fitness equipment unit 22, each fitness equipment unit 22 including its own associated input 24 and its own associated notifier 30. System 120 additionally includes a server or computer 38 remote from each of the individual fitness equipment units 22. Computer 38 includes one or more processing units and at least one memory or database containing information pertaining to a plurality of different potential users of fitness equipment units 22. In one embodiment, computer 38 is located within the same fitness facility containing a plurality of different fitness equipment units 22. In another embodiment, computer 38 is located at a fitness club headquarters remote from the fitness facility containing fitness equipment units 22. In still other embodiments, the different fitness equipment units 22 may be located at different fitness facilities, wherein computer 38 is located at one of the fitness facilities containing one of the fitness equipment units 22 or wherein computer 30 is located at the headquarters or other location remote from both of the fitness facilities containing the two or more different fitness equipment units 22. In some embodiments, virtual networks or computing clouds may also be employed.

As further shown by arrows 40 in FIG. 2, when different users start using different fitness equipment units 22, the input 24 of the different fitness equipment units 22 transmit or communicate user identification information to computer 38. Such communication may be made in a wired fashion, in a wireless fashion or combinations thereof. As shown by arrows 42, in response to receiving information from input 24 identifying the different users using the different fitness equipment units 22, computer 38 accesses the one more databases containing user information and returns user status information for each particular user to the particular notifier 30 associated with the fitness equipment unit 22 being used by the particular user. Thereafter, notifiers 30 communicate the received user status information as described above or communicate other status information based upon the received information from computer 38. Because computer 38 is in communication with multiple fitness equipment units 22, user status information may be centrally stored and located for multiple fitness equipment units 22. In addition, the user's exercise upon a particular fitness equipment unit 22 may be detected and transmitted to computer 38, allowing computer 38 to update information in its database pertaining to the user based upon the user's use of fitness equipment units 22.

The memory or database of computer 38 may additionally include information obtained from other sources such as a front desk or check-in location when a user initially enters a fitness facility. For example, a fitness facility may require the user to swipe his or her membership card upon entering a fitness facility. Computer 38 may then update its attendance database for the user. As a result, computer 38 may subsequently transmit updated information regarding the user to different fitness equipment units 22 being used by the user.

In applications where fitness equipment units 22 are located at different fitness facilities, computer 38 may provide updated user status information to different fitness equipment units at different facilities and may receive information from the different fitness equipment units, enabling computer 38 to update and maintain the accuracy of its database of user information even when the user may attend different fitness facilities. As a result, more accurate user status information regarding a user's overall attendance amongst a plurality of different fitness facilities may be maintained, improving the accuracy of the user information status information communicated by notifier 30 regardless of the particular fitness facility and particular fitness equipment unit 22 being used by the user.

Figure 3:
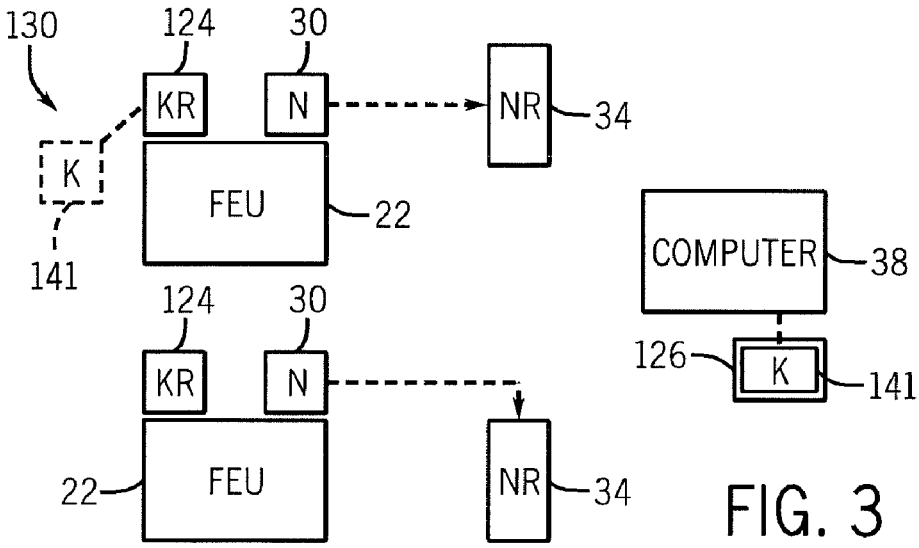
FIG. 3 is a schematic illustration of yet another embodiment of the user status notification system of FIG. 1.

FIG. 3 schematically illustrates user status notification system 130, another embodiment of user status notification system 20. User status notification system 130 is similar to user status notification system 120 except that user status notation system 130 transmits user status information or other information between computer 38 and notifier 30 of the fitness equipment units 22 using key readers 124, key writer 126 and a key 141. Key readers 124 comprise devices configured to scan, sense or otherwise read keys 141. Key readers communicate with notifiers 30 in a wired or wireless fashion. In one embodiment in which key 141 includes a magnetic memory strip, key writer 126 may include a slot or channel into which key 141 maybe inserted or swiped for obtaining user status information from the key 141. In another embodiment which key 141 comprises a flash memory or similar memory circuitry such as one including a radio frequency identification tag, key reader 124 may include flash card slot or a radiofrequency transponder for obtaining data from key 141. Although key reader 124 is illustrated as being external to computer 38, in other embodiments, key reader 124 may be provided as part of computer 38. Each key reader 124 is associated with a particular fitness equipment unit 22.

Key writer 126 comprises a device in communication with computer 38 and which is configured to write data or information on two key 141. Key writer 126 communicates with computer 38 in a wired or wireless fashion. In one embodiment in which key 141 includes a magnetic memory strip, key writer 126 may include a slot or channel into which key 141 maybe inserted or swiped for writing on the key 141. In another embodiment in which key 141 comprises a flash memory or similar memory circuitry such as one including a radio frequency identification tag, key writer 126 may include a flash card slot or a radiofrequency transponder for transferring data to key 141. Although key writer 126 is illustrated as being external to fitness equipment unit 22, in other embodiments, key writer 126 may be provided as part of its associated fitness equipment unit 22.

Key 141 comprises a token, card, jump drive or other portable object having a memory. Key 141 is configured so as to be at least written upon by computer 38 and at least read by each of key readers 124. In one embodiment, key 141 comprises a card having a magnetic strip upon which information is stored. In another embodiment, key 141 comprises a flash memory. In yet another embodiment, key 141 comprises a radiofrequency tag and associated memory. One example of key 141 is a fob key. In some embodiments, key 141 may also be configured to be written upon by card reader 124 and to be read or sensed by card writer 126. Key 141 temporarily stores user status information written upon it by computer 38 and then transfers the user status information to notifier 30 using card reader 124. In the example illustrated, key 141 Thursday dual-purpose but also so ring as an identification key or card for the particular user. In particular, each potential user of fitness equipment units 22 is assigned and given a key 141 which includes identification information for the particular user. As a result, key readers 124 additionally serve to identify the particular user at the particular fitness equipment unit 22. In other embodiments, the identification of a particular user at a particular fitness equipment unit 22 may alternatively be determined using the above described inputs 24, wherein key readers 124 merely obtain user status information from card 141.

According to one embodiment, when a user enters a fitness facility, the user swipes or otherwise positions his or her key 141 with respect to card writer 126. Card writer 126 reads or senses use identification from key 141 and updates attendance records for the user in the database maintained by computer 38. At the same time, key writer 126 writes or transfers user status information (described above) for the particular user from the database of computer 38 to the memory of key 141.

When the user selects a particular fitness equipment unit 22 for exercise, the user inserts, swipes or otherwise positions his or her assigned key 141 with respect to key reader 124 associated with the particular fitness equipment unit 22. Key reader 124 obtains the identity of the user and the user status information for the particular user from the memory of key 141. In some embodiments, key reader 124 merely obtains the user status information for the ticker user from key 141. Information obtained from key 141 is then communicated to notifier 30.

Notifier 30 communicates the user status information to those around the particular fitness equipment unit 22 who may offer encouragement or assistance to the user in the fashion described above. Notifier 30 may communicate other user status information based upon the user status information received from key 141 and other sensed or detected information. For example, notifier 30 may indicate certain information pertaining to the user which is based upon one or more of the user status information received from key 141, information input to notifier 30 using an input 24 and information obtained from fitness equipment unit 22 pertaining to the user's current exertion level or current exercise routine characteristics.

In one embodiment, key reader 124 may additionally write information to key 141 pertaining to the user's use of fitness equipment unit 22. This information may be subsequently transferred to computer 38 to update its database. For example, computer 38 may obtain such data from card 141 the next time the user logs in, thereby updating user status information regarding the user's familiarity with a particular fitness equipment unit 22 on the database of computer 38.

Figure 4:
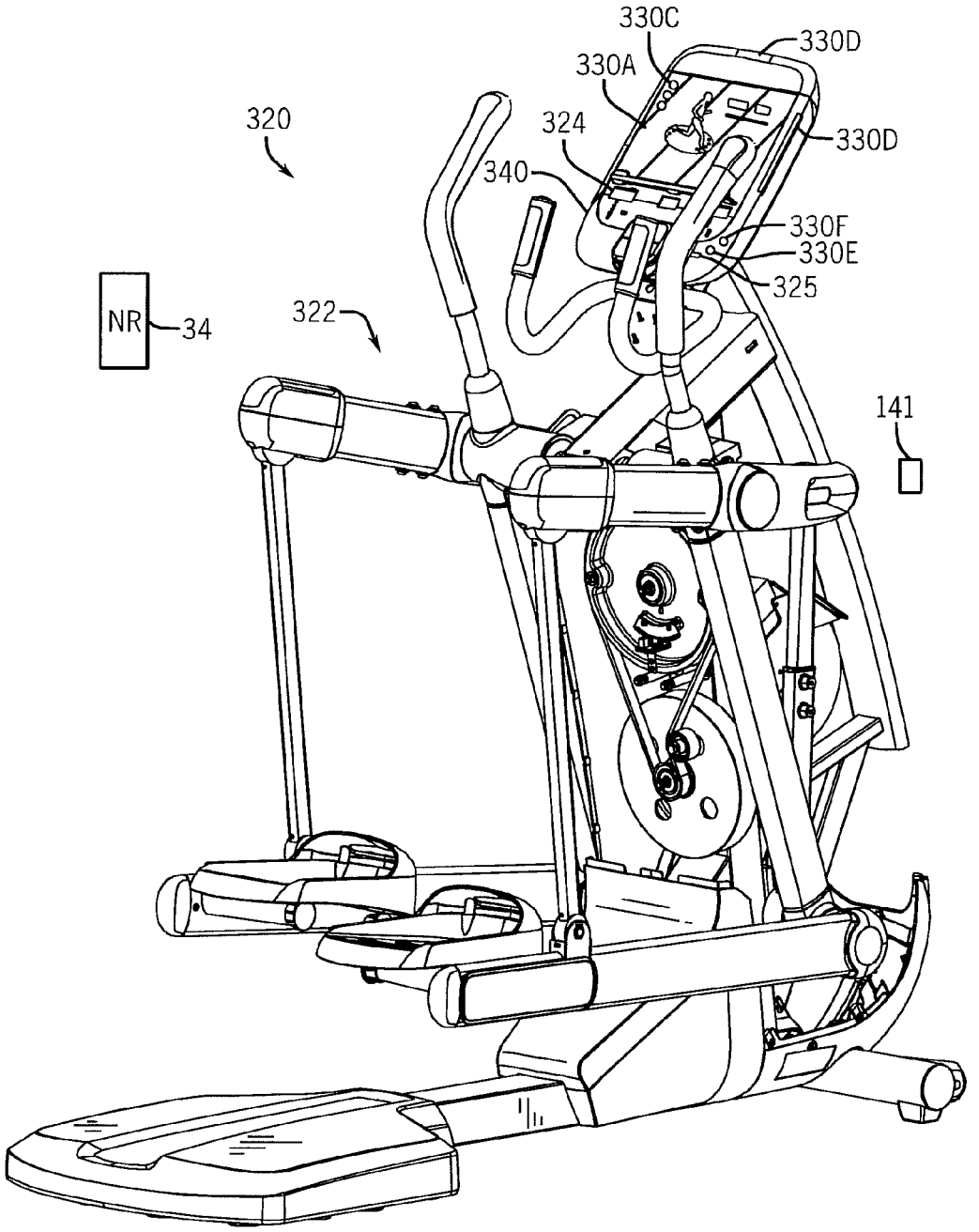
FIG. 4 is a perspective view of another embodiment of the user status notification system of FIG. 1.
Figure 5:
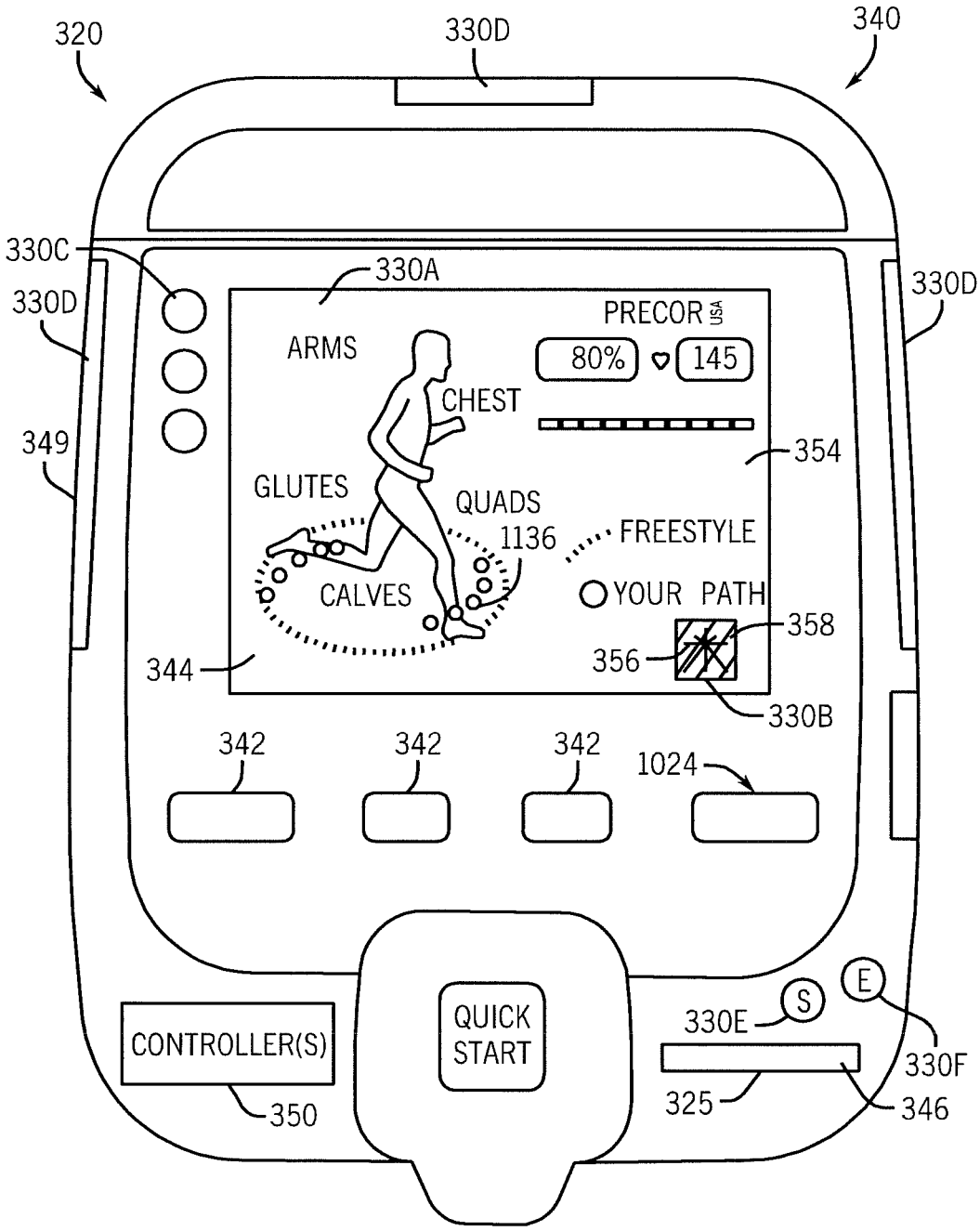
FIG. 5 is a front elevation of view of a fitness equipment unit monitor and various notifiers of the user status notification system of FIG. 4.

FIGS. 4 and 5 illustrate user status notification system 300, a particular embodiment of user status notification system 20. User status notification system 300 comprises fitness equipment unit 322, input 324, key reader 325, notifiers 330A, 330B, 230C, 330D, 330E and 330F (collectively referred to as notifiers 330), notification recipient 34, computer 38, key writer 126 and key 141. Recipient 34, computer 38, key writer 126 and key 141 are shown and described above with respect to FIGS. 1-3. In particular embodiments, one of more of notification recipient 34, computer 38, key writer 126 and key 141 may be omitted.

Fitness equipment unit 322 comprises an adaptive motion exercise device such as that described in the pending U.S. patent application Ser. No. 12/154,916 filed on May 28, 2008 by David E. Dyer, Sean Horita, James S. Birrell, Rodney P. West, and Jonathan M. Stewart and entitled EXERCISE DEVICE VISUAL REPRESENTATION, the full disclosure of which is hereby incorporated by reference. In alternative embodiments, fitness equipment unit 322 may comprise other types of exercise machines, including both cardiovascular exercise machines/equipment and weight lifting/strength machines/equipment, providing variable two and/or three dimensional paths of motion for the upper and/or lower body of the user.

Input 324 comprises a device associated with fitness equipment unit 322 that is configured to receive input identifying a particular human user using fitness equipment unit 322. In the example illustrated, input 324 is associated with fitness equipment unit 322 by being directly connected to, mounted upon or provided as part of a display or control panel 340 of fitness equipment unit 22. In another embodiment, input 324 may be associated with fitness equipment unit 322 by being located within a particular area or region of a facility containing fitness equipment unit 22. For example, input 324 may be provided adjacent a door to a room containing fitness when the unit 322 or on a wall proximate to fitness equipment unit 322.

As shown by FIG. 5, input 324 comprises a user interaction device that actively requests, prompts or receives input directly from the person using the fitness of unit 322 (or entering the region containing fitness equipment unit 22. In the example illustrated, input 324 comprises a series of input buttons 342 and a touch screen 344 facilitating user identification input. In other embodiments, input 324 may additionally or alternatively comprise a keyboard, keypad, a microphone with a computing device having associated voice or speech recognition software, a card reader or a biometric sensing device, wherein the person using fitness equipment unit 22 enters his or her identification information either manually, audibly or by positioning a card (magnetic or electronic) in a card reader or by positioning his or her anatomy with respect to the biometric sensing device.

In yet other embodiments, input 324 may comprise a passive person identification device which identifies a person using fitness equipment unit 322 without any active participation or specific actions on part of the person using fitness equipment unit 322. For example, input 324 may comprise a camera or other image capturing device and a computing device having associated face recognition software. Input 324 may comprise a sensing device that senses a security or identification token, sometimes referred to as a key fob, assigned or designated to the particular user or person and located within a predetermined proximity to the sensing device, such as when the person is seated upon a portion of the fitness equipment unit or is using the fitness equipment unit. In some embodiments, such identification tokens may rely on radio frequency identification tags and transponders. Overall, input device 324 provides notifiers 30, including controller(s) 350, with the identity of the particular person using or about to use fitness equipment unit 22.

Key reader 325 (shown in FIG. 5) comprises a device configured to scan, sense or otherwise read key 141. Key reader 325 communicates with notifiers 330 in a wired or wireless fashion. In one embodiment in which key 141 includes a magnetic memory strip, key reader 325 include a slot or channel 346 into which key 141 may be inserted or for obtaining user status information from the key 141. In another embodiment which key 141 comprises a flash memory or similar memory circuitry such as one including a radio frequency identification tag, key reader 325 may comprise a flash card slot. In other embodiments where key 141 includes a radiofrequency tag and memory, key reader 325 may comprise a radiofrequency transponder. In some embodiment, one of input 324 or key reader 325 may be omitted.

Notifiers 330 each comprise a device having one or more electromagnetic emitting elements 349 and one or more controllers 350 actuatable to notify or indicate to those persons or individuals around or proximate to fitness equipment unit 322, who are not using fitness equipment unit 322, information or data regarding or pertaining to the person using fitness equipment unit 322 while the person is using fitness equipment unit 322. Examples of individuals who may be proximate to fitness equipment unit 322 but not using fitness equipment unit 322 include persons who may be walking around or about fitness equipment unit 322 while the person is using fitness equipment unit 322. Such persons may include coaches, trainers, fitness facility representatives or managers and the like who may be able to offer assistance or encouragement.

In the example illustrated, notifiers 330 are provided as part of a display screen, control panel or monitor 340 associated with fitness equipment unit 322. In yet another embodiment, one or more of notifiers 330 may comprise one or more lights or illumination devices or one or more sound emitting devices mounted to fitness equipment unit 322 or supported at a location proximate to fitness equipment unit 322, such as a wall, floor or other structure in close proximity to fitness equipment unit 322.

In the example illustrated, user notification system 320 including multiple notifiers 330. The emitting elements 349 of each of notifiers 330 is under control of and selectively actuated by one or more controllers 350 (schematically shown). The one or more controllers 350 comprise one or more processing units configured to generate control signals directing the actuation of the emitting elements 349 of notifiers 330. In one embodiment, controllers 350 may additionally analyze user status information obtained from computer 38, data input via input 324, instructions or commands entered via input 324 and sensed data received from fitness equipment unit 322 regarding the current exercise program or routine carried out or regarding sensed physical characteristics of the user such as his or her heart rate and the like. Based on this analysis or such data, controllers 350 generate such control signals directing the actuation of notifiers 330. An example illustrates how the one or more controllers 350 further generate control signals directing the operation of fitness equipment unit 322 as well as the presentation of information or data on monitor 340.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controllers 350 may be embodied as part of one or more application-specific integrated circuits (ASICs). Unless otherwise specifically noted, the controller is not limited to any specific combination of hardware circuitry and software, nor to any particular source for the instructions executed by the processing unit.

Notifier 330A communicates user status information (described above with respect to FIG. 1) using one or more background colors on display 354 as schematically shown by diagonal hatch lines in FIG. 4. Each background color may correspond to or be associated with different user status information. For example, different colors may be associated with different membership durations, different levels of attendance or different fitness equipment familiarity. In one embodiment, background color is a solid color that remains solid during the user's use of fitness equipment unit 322. In another embodiment, additional information may be communicated based on the frequency at which the background color changes or based on an extent of the background screen that has changed color. In other preferred embodiments, iconographic symbols and images can be used to indicate user status information.

Notifier 330B communicates user status information using a designated part of display 354. In this designated area of display 354, particular graphics 356 or particular colors 358 (represented by diagonal hatch lines) associated with different user status information may be presented. In one embodiment, the graphics are codified so as to not directly communicate the particular status information to anyone without a key or without knowledge of what the codified graphic represents. In this way, privacy of the user status information is maintained.

Notifier 330C comprises one or more light emitting diodes, LCDs, or illumination bars which may be selectively lit to different brightnesses, alternate blinking lights (potentially at various intervals), different colors or different extents to indicate user status information such as different membership to durations, different levels of attendance or different fitness equipment familiarity. Notifier 330D comprised larger portions of monitor 340 which are selectively eliminated to communicate or indicate user status information. Notifiers 330D extend along larger portions or along perimeters of panel 340 so as to be more visually noticeable to those not using fitness equipment unit 322. User status information may be indicated by notifier 330D based upon the color, brightness or illumination frequency.

Notifier 330E comprises a speaker or other auditory signal emitting device. Notifier 330 communicates or indicates different user status information based upon sounds or patterns of sounds emitted by notifier 330. That sounds many clicks, beeps or short durations of music such as ring tones.

Notifier 330F comprises a device configured to communicate user status information by emitting non-human perceptible signals which are configured to be received by notification recipient 34 (shown in FIG. 4) or by an intermediate device which directs notification receiver 34 based upon such non-human perceptible signals. It one embodiment, notifier 330 utilizes radiofrequency waves. In another embodiment, notifier 330F utilizes human imperceptible auditory signals or other imperceptible electromagnetic radiation frequencies.

According to one embodiment, notifiers 330 are operable in one of a plurality of different selectable notification modes based upon commands or selections provided to controllers 350 using input 324. In a first mode of operation, each of notifiers 330 is concurrently actuated to communicate the same user status information. For example, each of notifiers 330 may be actuated to communicate or indicate the user's attendance. In a second mode of operation, some of notifiers 330 may be chosen to indicate a first type of user status information while other of notifiers 330 may be chosen to indicate a second type of user status information. In one embodiment, each of notifiers 330 may concurrently communicate or indicate a distinct type of user status information. For example, notifier 330A may indicate a user's familiarity with the particular fitness equipment unit growth 322, notifier 330D may communicate a user's attendance level and notifier 330C may indicate a user's membership duration. In some embodiments, two or more of such notifiers 330 may communicate the same user status information while other notifiers number 330 communicates with different user status information. In yet a third mode, in response to input from a fitness facility representative or other decision-maker, controllers 350 may disable selected notifiers 330 and utilize other selected notifiers 330 for use in communicating user status information. In other embodiments, user status notification system 320 may include a greater or fewer of such notifiers 330.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A user status notification system comprising:

a fitness equipment unit comprising a cardiovascular or strength conditioning exercise device;

an input associated with the fitness equipment unit that receives input identifying a human user using the fitness equipment unit; and a visible notifier associated with the fitness equipment unit to provide a visible indication, on the fitness equipment unit, that visibly indicates to non-users proximate the fitness equipment unit status information pertaining to the user while the user is using the fitness equipment unit, wherein the status information provided by the notifier is codified so as to not directly communicate the status information to anyone without a key or without knowledge of what the codified status information represents to maintain privacy of the status information, wherein the status information is selected from a group consisting of: an age of the user's membership at a fitness club; the user's frequency of attendance at a fitness club and a number of times, a number of days or a number of workouts on the fitness equipment unit by the user.

2. The notification system of claim 1, where the status information indicates a comparison of the number of times, the number of days or the number of workouts on the fitness equipment unit by the user to a corresponding predefined threshold.

3. The notification system of claim 1, wherein the fitness equipment unit includes a display screen and wherein the notifier comprises a background color presented on the display screen, wherein alphanumeric data is displayed on top of and in contact with the background color.

4. The notification system of claim 1, wherein the status information relates to an exertion level of the user on the fitness equipment unit during exercise.

5. The notification system of claim 1, wherein the notifier comprises one or more light emitting diodes.

6. The notification system of claim 1, wherein the fitness equipment unit includes a display screen and wherein the notifier comprises a dedicated area of the screen having iconographic images or symbols providing information on or related to the fitness equipment unit being used or an exercise routine being performed on the fitness equipment unit by the user.

7. The notification system of claim 1 further comprising a centralized computer containing attendance data and in communication with a plurality of fitness equipment units including the fitness equipment unit, wherein the notifier is actuated based upon attendance data received from the centralized computer.

8. The notification system of claim 1 further comprising a centralized computer containing club membership data and in communication with a plurality of fitness equipment units including the fitness equipment unit, wherein the notifier is actuated based upon club membership data received from the centralized computer.

9. The notification system of claim 1 further comprising:

a computer;

a key receiving user status information from the computer, wherein the key transfers the user status information to the fitness equipment unit upon initiation of use of the fitness equipment unit by the user.

10. The notification system of claim 1, wherein the notifier emits wireless human imperceptible signals including the status information and wherein the system further comprises a portable handheld notification receiver configured to receive the human imperceptible signals and convert the human imperceptible signals to a human perceptible signals.

11. The notification system of claim 1 further comprising a plurality of notifiers, each notifier being actuatable to indicate to non-users proximate the fitness equipment unit a different type of status information pertaining to the user while the user is using the fitness equipment unit.

12. The notification system of claim 1, wherein the notifier is physically supported by the fitness equipment unit.

13. A user status notification system comprising:

a fitness equipment unit comprising a cardiovascular or strength conditioning exercise device;

an input associated with the fitness equipment unit that receives input identifying a human user using the fitness equipment unit;

a notifier physically supported by the fitness equipment unit and actuatable to indicate to non-users proximate the fitness equipment unit status information pertaining to the user while the user is using the fitness equipment unit, wherein the notifier emits wireless human imperceptible signals including the status information;

a portable handheld notification receiver configured to receive the signals and convert the imperceptible signals to a human perceptible signals, wherein at least one of the notifier and the portable handheld notification receiver are configured such that the human perceptible signals are only provided when the portable handheld notification receiver is within a predetermined threshold distance from the notifier, wherein the portable handheld notification receiver is configured to change at least one of an illumination level, a color or an off/on state upon two criteria being satisfied: (1) the notification receiver being located within the predetermined threshold distance of the notifier and (2) the user of the fitness equipment unit meeting a predetermined user criteria threshold, wherein the predetermined user criteria threshold is selected from a group of thresholds comprising: membership age, frequency of attendance, and a number of times, a number of days or a number of workouts on the fitness equipment unit by the user.

14. The notification system of claim 13, wherein the predetermined threshold distance is 10 feet.

15. A user status notification system comprising:

a fitness equipment unit;

an input associated with the fitness equipment unit that receives input identifying a human user using the fitness equipment unit; and a notifier supported by the fitness equipment unit and actuatable to indicate to non-users proximate the fitness equipment unit status information pertaining to the user while the user is using the fitness equipment unit, wherein the fitness equipment unit includes a display screen and wherein the notifier comprises a background color presented on the display screen, wherein the background color indicates a status selected from a group consisting of: an age of the user's membership at a fitness club; the user's frequency of attendance at a fitness club and a number of times, a number of days or a number of workouts on the fitness equipment unit by the user.

16. The notification system of claim 15, wherein the background color indicates an age of the user's membership at a fitness club.

17. The notification system of claim 15, wherein the background color indicates the user's frequency of attendance at a fitness club.

18. The notification system of claim 15, where the background color indicates a comparison of the number of times, the number of days or the number of workouts on the fitness equipment unit by the user to a corresponding predefined threshold.

19. The notification system of claim 15, wherein the status information provided by the notifier is codified so as to not directly communicate the particular status information to anyone without a key or without knowledge of what the codified status information represents to maintain privacy of the status information.

20. A user status notification system comprising:

a fitness equipment unit comprising a cardiovascular or strength conditioning exercise device;

an input associated with the fitness equipment unit that receives input identifying a human user using the fitness equipment unit; and a non-alphanumeric visible notifier associated with the fitness equipment unit and actuatable to indicate to non-users proximate the fitness equipment unit status information pertaining to the user while the user is using the fitness equipment unit, wherein the status information indicates an age of the user's membership at a fitness club.

21. A user status notification system comprising:

a fitness equipment unit comprising a cardiovascular or strength conditioning exercise device;

an input associated with the fitness equipment unit that receives input identifying a human user using the fitness equipment unit;

a non-alphanumeric visible notifier associated with the fitness equipment unit and actuatable to indicate to non-users proximate the fitness equipment unit status information pertaining to the user while the user is using the fitness equipment unit; and a centralized computer containing attendance data and in communication with a plurality of fitness equipment units including the fitness equipment unit, wherein the notifier is actuated based upon attendance data received from the centralized computer.

22. A user status notification system comprising:

a fitness equipment unit comprising a cardiovascular or strength conditioning exercise device;

an input associated with the fitness equipment unit that receives input identifying a human user using the fitness equipment unit;

a non-alphanumeric visible notifier associated with the fitness equipment unit and actuatable to indicate to non-users proximate the fitness equipment unit status information pertaining to the user while the user is using the fitness equipment unit; and a centralized computer containing club membership data and in communication with a plurality of fitness equipment units including the fitness equipment unit, wherein the notifier is actuated based upon club membership data received from the centralized computer.

* * * * *